United States Patent [19]

Strumbos

[11] Patent Number: 4,553,284

[45] Date of Patent: Nov. 19, 1985

[54] VACUUM CLEANER UNIVERSAL NOZZLE

[76] Inventor: William P. Strumbos, 85 Middleville Rd., Northport, N.Y. 11768

[21] Appl. No.: 588,911

[22] Filed: Mar. 12, 1984

[51] Int. Cl.[4] ..... A47L 9/02

[52] U.S. Cl. ..... 15/414; 15/415 R; 15/418; 15/420

[58] Field of Search ..... 15/415 R, 414, 418, 15/420, 421, 422, 393

[56] References Cited

U.S. PATENT DOCUMENTS

| | | | |
|---|---|---|---|
| 577,362 | 2/1897 | Ettlinger | 15/415 A X |
| 2,068,496 | 1/1937 | Linghammar | 15/415 R |
| 2,908,933 | 10/1959 | Todd et al. | 15/415 R X |
| 3,922,753 | 12/1975 | Aberilla | 15/414 X |

FOREIGN PATENT DOCUMENTS

| | | | |
|---|---|---|---|
| 66250 | 8/1950 | Netherlands | 15/414 |

*Primary Examiner*—Chris K. Moore

[57] ABSTRACT

A universal nozzle which has a tubular body with a coupling end that fits on the hose of a vacuum cleaner and an inlet end distal from the coupling end. The nozzle has a smooth bore and is made from a resilient material which is manually deformable such that the inlet opening and configuration can be altered by the operator to suit operating conditions. The nuzzle material has sufficient resiliency to regain its original configuration after being manually deformed and to resist collapse because of suction pressures whether in a deformed or undeformed condition. A synthetic organic compound such as plastic resin or a natural material alloyed with fillers or reinforcing agents to produce a formulation having a Shore-A hardness of 60–95, preferably 80±10, is a particularly suitable nozzle material.

13 Claims, 10 Drawing Figures

VACUUM CLEANER UNIVERSAL NOZZLE

FIELD OF THE INVENTION

This invention relates to nozzles for vacuum cleaners and, more particularly, to a resilient tubular nozzle that is readily deformable such that the nozzle inlet configuration can be altered to meet operating conditions.

BACKGROUND OF THE INVENTION

Vacuum cleaners are conventionally provided with nozzles that are specifically shaped for the particular cleaning task to be undertaken. Conventional nozzle and nozzle attachments are usually made of a metal or a tough impact-resistant plastic. These nozzles are available in various configurations including cylindrical types, narrow crevice tools, and wide rectangular types, and they are sometimes provided with bristles. Because these nozzles are fabricated out of a rigid material, it is not possible to alter the shape or the nozzle opening to accommodate variations in operating conditions. Thus, if an open surface area is being vacuumed and it becomes necessary to vacuum a narrow opening or restricted area, a change from a broad, rectangular nozzle to a narrow nozzle or crevice tool is required.

DESCRIPTION OF THE PRIOR ART

In order to overcome the disadvantages of rigid nozzles a nozzle made of a soft, flexible material was proposed in the prior art in U.S. Pat. No. 2,068,496, by L. Linghammar. However, to prevent the collapse of the nozzle opening under suction pressure as a consequence of the soft material used for the nozzle, it was believed necessary to provide the interior of the nozzle with a multiplicity of integral inwardly extending ribs to give the nozzle the necessary rigidity to withstand the negative pressures to which it was subjected. These ribs, of course, served to disturb the airflow through the nozzle and acted to trap dirt and other foreign matter such that the efficiency of the nozzle was adversely affected. The ribs also prevented the closing off of a portion of the nozzle to vary the size of the opening thereof.

SUMMARY OF THE INVENTION

The universal nozzle of this invention comprises a resilient tubular element having a coupling end that fits on the hose of a vacuum cleaner and a nozzle inlet end distal from the coupling end. The tubular element has a smooth bore and is made from a resilient material which is deformable manually by the operator such that the shape and size of the nozzle inlet opening can be varied. It has been discovered, contrary to the teachings of the prior art, that integral strengthening ribs are not required for the proper functioning of a resilient, deformable nozzle. It has been found that by properly designing the nozzle, it can be selectively deformed manually yet will regain its original shape upon release of that manual pressure in spite of the suction pressures the nozzle is simultaneously undergoing.

It is thus a principal object of the invention to provide a vacuum cleaner nozzle having at least the nozzle inlet opening thereof made from a deformable resilient material such that the shape and size of the nozzle inlet opening can be selectively altered manually by the operator as operating conditions dictate.

It is a related object of the invention to provide a vacuum cleaner nozzle made of a material selectively deformable manually, the design of which does not require integral stiffening or reinforcing ribs in the bore of the nozzle.

DESCRIPTION OF THE DRAWINGS

For the purpose of illustrating the invention, there is shown in the drawings the forms which are presently preferred; it should be understood, however, that the invention is not necessarily limited to the precise arrangements and instrumentalities here shown.

DESCRIPTION OF THE PREFERRED EMBODIMENTS

Figure 1:
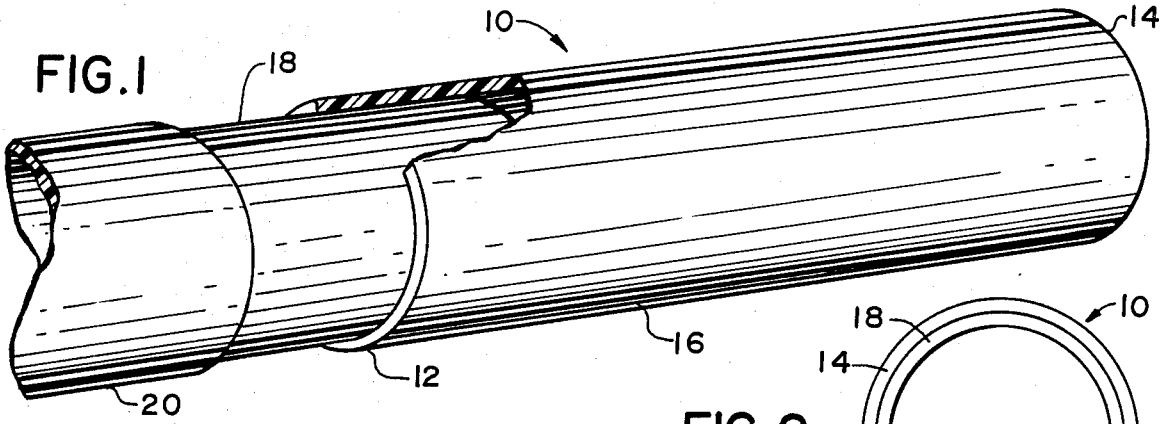
FIG. 1 is a perspective view partially in section of the universal nozzle of the invention showing it connected to a source of suction pressure.
Figure 2:
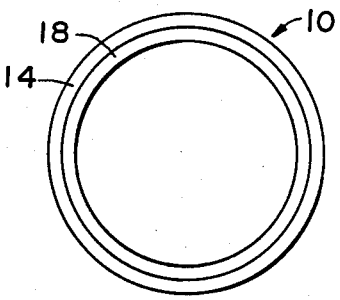
FIG. 2 is an end view of the nozzle of FIG. 1.

With reference now to FIGS. 1 and 2, in particular, there is shown the resilient nozzle 10 of the invention having a cylindrical coupling end 12, a nozzle inlet end 14, and a tubular body portion 16 therebetween. Because of cost and manufacturing considerations, it is preferable to make the elements of the entire nozzle integral and of the same material, although the coupling end 12 can be formed of one material and the body portion 16 and the inlet end 14 of another resilient material. Preferably the resilient material is a synthetic organic substance such as a plastic resin or a suitable organic material alloyed with fillers or reinforcing agents to impart the required physical properties to the nozzle. The material used must impart sufficient flexibility to the nozzle to permit it to be deformed selectively under normal finger pressure by the operator, yet the material should exhibit sufficient resiliency to restore the nozzle to its original configuration when the operator releases the finger pressure thereon. The material also should possess sufficient resiliency to withstand in the deformed or undeformed condition a collapse of the nozzle due to the suction pressures induced by the vacuum source. I have found that the required physical properties can be obtained with a suitable chlorosulfonated polyethylene, a chlorobutyl rubber, a styrene butadiene rubber, or a nitrile rubber formulated to have a Shore A hardness ranging from 60–95, preferably 80±10.

Preferably the formulation also has the following properties:

| | |
|---|---|
| Specific Gravity | 1.1–1.3 |
| Tensile Strength - psi | 2400–3800 |
| Elongation - % | 200–600 |
| Tear Resistance - lb/in | 145–260 |

-continued

| | |
|---|---|
| Brittle Temperature - °F. | −70 |
| Compression Set - % | below 20 |

Figure 3:
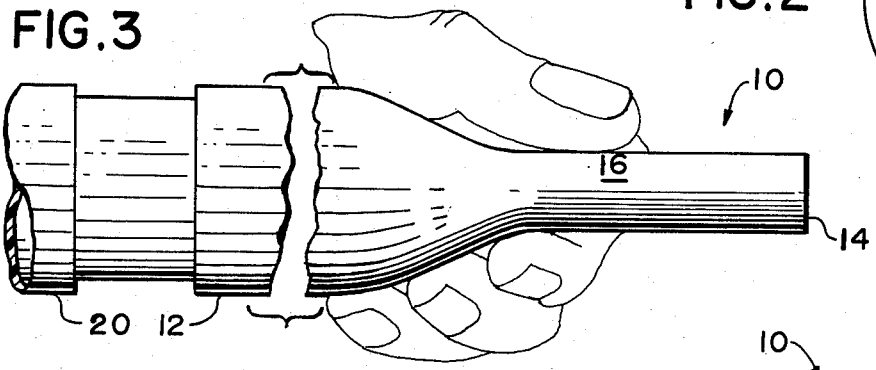
FIG. 3 is a side elevation of the nozzle of FIG. 1 being deformed to alter the shape of the nozzle inlet.
Figure 4:
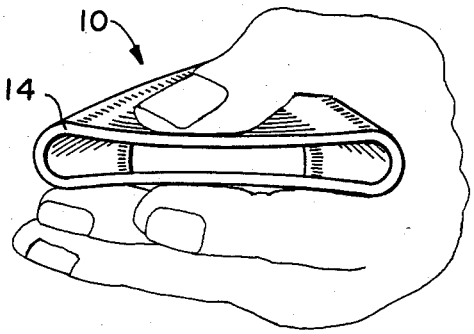
FIG. 4 is an end view of the deformed nozzle of FIG. 3.
Figure 5:
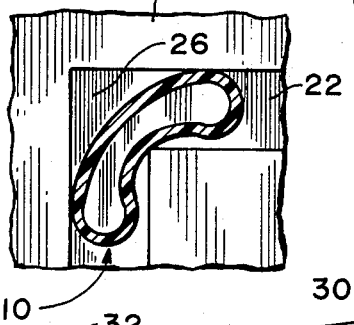
FIG. 5 is a cross-sectional view of the inlet end of the nozzle of FIG. 1 deformed to conform to an irregular slot in a surface.
Figure 6:
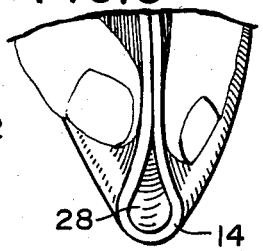
FIG. 6 is an end view of the nozzle of FIG. 1 being deformed to alter the opening thereof.

In operation, the coupling end 12 of the nozzle will be connected to a source of suction pressure, such as to the end fitting 18 of the suction hose 20 of a vacuum source such as a vacuum cleaner (not shown). In use, the vacuum source creates an air stream moving at high speed into the inlet end 14 and through the nozzle into the vacuum hose of the vacuum cleaner. This air stream moving into the nozzle entrains dust, fragmentary matter, lint, and the like, and can include liquids. In use, the inlet end of the nozzle is passed along the surface to be vacuumed, sucking up to the extraneous matter therefrom. Because of the resiliency of the nozzle, the operator can deform it to conform closely with the surface undergoing cleaning even though the surface is irregular. Should it be necessary to vacuum a narrow opening in the surface, the operator deforms the nozzle manually as shown in FIGS. 3 and 4 to alter the nozzle inlet configuration to the shape required. If the narrow opening is an irregular slot 22 in a surface 24, the nozzle inlet end 14 has sufficient flexibility to conform to a right angle bend 26 as indicated in FIG. 5 or other irregularity as the nozzle is moved along the slot. It is possible to vary the area of the nozzle inlet opening to produce a lesser opening 28 if the walls of inlet end 14 are squeezed together as indicated in FIG. 6. Vacuum cleaning performance is a function of the volume of air entrained through the inlet nozzle. The highest volume of air is entrained with the nozzle fully open, but the greatest vacuum potential is obtained when the nozzle inlet is pressed hard against a surface or when the walls of the inlet are pressed together to close off the air therethrough. Thus, the heavier the particles to be picked up, the greatest volume of intake air should be provided to start the particles moving, and the higher the air velocity to keep them in suspension until they reach the filtering means in the vacuum cleaner where they are separated from the air stream.

Figure 7:
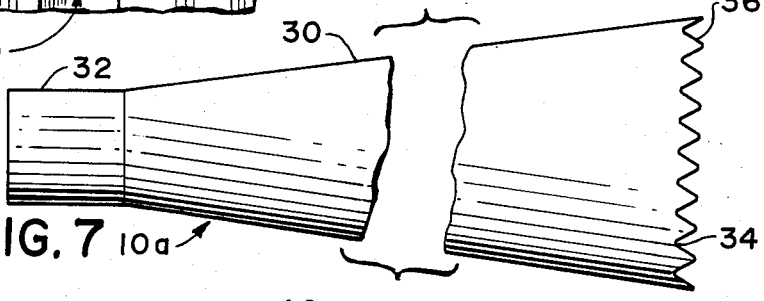
FIG. 7 is a side elevation of a further embodiment of the universal nozzle of the invention.
Figure 8:
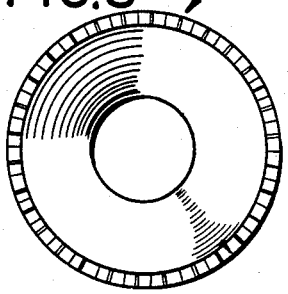
FIG. 8 is an end view of the nozzle embodied in FIG. 7.

A further embodiment of the invention is illustrated in FIGS. 7 and 8. In that embodiment, the nozzle **10*a* comprises a conical or funnel-shaped body portion 30 which has a cylindrical coupling 32 at one end and an inlet 34 at the other end. The edge 36 of the inlet 34 of the nozzle 10*a*** can be serrated to prevent too perfect a seal with the surface undergoing cleaning.

Figure 9:
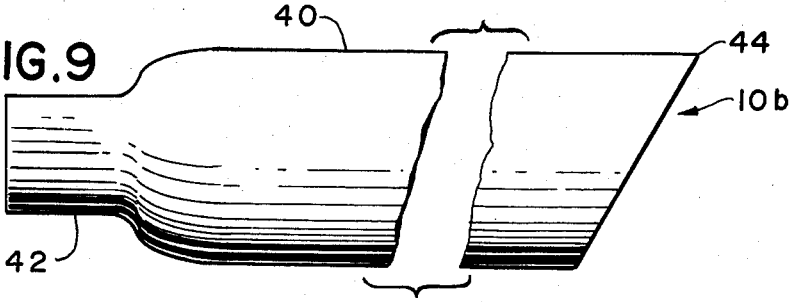
FIG. 9 is a side elevation of a yet further embodiment of the universal nozzle of the invention.
Figure 10:
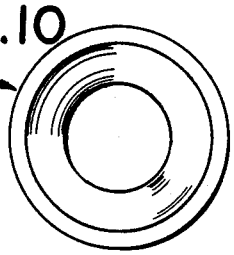
FIG. 10 is an end view of the nozzle embodied in FIG. 9.

A yet further embodiment of the invention is the nozzle **10*b* shown in FIGS. 9 and 10. Nozzle 10*b* comprises a cylindrical body portion 40 which has a cylindrical coupling 42 at one end and an inlet 44 at the other end. Unlike nozzle 10 of FIGS. 1–6 in which the body portion 16, the coupling end 12, and the inlet end 14 are substantially of the same diameter, the cylindrical coupling 42 of nozzle 10*b* has one diameter and its body portion 40 has a greater diameter. In FIG. 9, the nozzle 10*b* is shown as having its inlet end 44 formed at an angle to the longitudinal axis of the nozzle, but an inlet end formed perpendicular to the longitudinal axis can also be provided. It will be appreciated that the FIGS. 7–10 embodiments of the invention will be fabricated from the same materials of construction and will have the same physical properties set forth for the FIG. 1–6** embodiment.

In each of the embodiments of the invention described herein the resiliency that restores the nozzle to its original configuration upon release of pressure thereon tending to distort it even when it is subjected to vacuum cleaner suction pressures is imparted to the nozzle by the material from which it is constructed. The nozzles, thus, have a smooth bore and the internal strengthening ribs taught in the prior art are not required.

Although shown and described in what is believed to be the most practical and preferred embodiments, it is apparent that departures from the specific apparatus described will suggest themselves to those skilled in the art and may be made without departing from the spirit and the scope of the invention. I, therefore, do not wish to restrict myself to the instrumentalities illustrated and described, but desire to avail myself to all modifications that may fall within the compass of the appended claims.

Having thus described my invention, what I claim is:

1. A resilient universal nozzle for vacuum cleaning apparatus, said nozzle comprising an elongated tubular element with a coupling end which fits on a tubular pipe means in fluid communication with a source of subatmospheric pressure and a body portion terminating in a nozzle inlet end distal from said coupling end, said tubular element having a smooth bore, at least said body portion and nozzle inlet end comprising material which is deformable under manual pressure by the operator and having sufficient resiliency in operation and under suction pressures such that it returns to its original undeformed configuration upon release of said manual pressure, said resiliency preventing the collapse of said nozzle when subjected to material entraining suction pressures in either the deformed or undeformed condition, whereby the size and shape of at least the nozzle inlet end can be altered controllably to suit the operating requirements.

2. The resilient universal nozzle set forth in claim 1 wherein said material is such that the manual deformation of the nozzle inlet end varies the shape and size of the nozzle inlet opening such that the airflow and suction pressure therethrough can be selectively altered.

3. The resilient universal nozzle set forth in claim 1 wherein the smooth interior walls of said nozzle allow selected areas thereof to be pinched together selectively to reduce the size of the nozzle opening.

4. The resilient universal nozzle set forth in claim 1 wherein said material is such that the nozzle inlet end can be selectively deformed from an undeformed shape of greatest nozzle inlet opening for a greater volume of intake air to move heavier particles to a deformed shape having a lesser nozzle inlet opening for a greater vacuum potential to keep said particles in suspension to maintain their movement whereby the vacuum cleaning operation is improved thereby.

5. The resilient universal nozzle set forth in claim 1 wherein said nozzle is made of a resilient organic substance formulated to have a hardness ranging from 60–95 Shore A.

6. The resilient universal nozzle set forth in claim 5 wherein the organic substance is a chlorosulfonated polyethylene.

7. The resilient universal nozzle set forth in claim 5 wherein the organic substance is a chlorobutyle rubber.

8. The resilient universal nozzle set forth in claim 5 wherein the organic substance is a styrene butadiene rubber.

9. The resilient universal nozzle set forth in claim 5 wherein the organic substance is a nitrile rubber.

10. The resilient universal nozzle set forth in claim 1 wherein said nozzle has a hardness of 80±10 Shore A.

11. The resilient universal nozzle set forth in claim 1 wherein the nozzle end is provided with means for preventing a close seal with a surface undergoing cleaning.

12. The resilient universal nozzle set forth in claim 11 wherein the means for preventing a close seal are serrations formed around the edge of the nozzle inlet end.

13. The resilient universal nozzle set forth in claim 1 wherein the nozzle inlet end is formed at an angle with the longitudinal axis of said nozzle.

* * * * *